US005108634A

United States Patent [19]

Seiki

[11] Patent Number: 5,108,634

[45] Date of Patent: Apr. 28, 1992

[54] LUBRICATING OIL COMPOSITION COMPRISING A SPECIFIED BASE OIL AND AN ALKYL SUBSTITUTED PHENOL

[75] Inventor: Hiromichi Seiki, Ichihara, Japan

[73] Assignee: Idemitsu Kosan Company Limited, Tokyo, Japan

[21] Appl. No.: 415,327

[22] PCT Filed: Jan. 25, 1989

[86] PCT No.: PCT/JP89/00064

§ 371 Date: Sep. 8, 1989

§ 102(e) Date: Sep. 8, 1989

[87] PCT Pub. No.: WO89/07129

PCT Pub. Date: Aug. 10, 1989

[30] Foreign Application Priority Data

Jan. 29, 1988 [JP] Japan ..... 63-17334

[51] Int. Cl.[5] ..... C10M 129/10

[52] U.S. Cl. ..... 252/52 R

[58] Field of Search ..... 252/52 R

[56] References Cited

U.S. PATENT DOCUMENTS

| | | | |
|---|---|---|---|
| 2,202,825 | 6/1940 | Brandes | 252/52 R |
| 2,623,855 | 12/1952 | Garner | 252/52 R |
| 2,862,976 | 12/1958 | Dubbs et al. | 252/52 R |
| 3,271,314 | 9/1966 | Ecke et al. | 252/52 R |
| 3,476,838 | 11/1969 | Ecke et al. | 252/52 R |
| 3,530,069 | 9/1970 | O'Neill | 252/52 R |
| 3,692,679 | 9/1972 | O'Neill | 252/52 R |
| 3,759,831 | 9/1973 | Andress | 252/52 R |
| 3,794,595 | 2/1974 | Latos | 252/52 R |
| 3,816,544 | 6/1974 | Brindell et al. | 252/52 R |
| 4,427,563 | 1/1984 | Hutchison | 252/52 R |
| 4,776,967 | 10/1988 | Ichihashi et al. | 252/52 R |
| 4,812,246 | 3/1989 | Yabe | 252/52 R |
| 4,836,943 | 6/1989 | Kapuscinski et al. | 252/52 R |
| 4,853,139 | 8/1989 | Ichihashi | 252/52 R |

*Primary Examiner*—Prince Willis, Jr.
*Assistant Examiner*—Jerry D. Johnson
*Attorney, Agent, or Firm*—Antonelli, Terry, Stout & Kraus

[57] ABSTRACT

There is disclosed a lubricating oil composition which comprises, as main components, (A) 100 parts by weight of a base oil having a kinematic viscosity at 40° C. of 5 to 500 cSt, a pour point of −30° C. or lower and a viscosity index of 70 or more, or further a cloud point of −20° C. or lower, and (B) 0.01 to 5 parts by weight of an alkyl group-substituted phenol compound a melting point of 20° C. or lower.

This lubricating oil composition has excellent high temperature stability and low temperature characteristics, and thus it is suitable for a refrigerator oil, a heat pump oil, etc.

3 Claims, No Drawings

LUBRICATING OIL COMPOSITION COMPRISING A SPECIFIED BASE OIL AND AN ALKYL SUBSTITUTED PHENOL

DESCRIPTION

Technical Field

This invention relates to a lubricating oil composition, more specifically to a lubricating oil composition which has excellent high temperature stability and also excellent low temperature characteristics, and is suitable as a refrigerator oil, a heat pump oil, etc.

Background Art

In recent years, the tendency of increasing high efficiency, miniaturization and weight reduction have rapidly progressed in refrigerators, and the reciprocating system in compressors has changed to the rotary system. Further, there is a tendency that the temperature of exhaust gas is rising due to loading of an inverter or recovery of exhaust heat by a heat pump. Therefore, it is strongly required of a refrigerator oil, etc. to have high temperature stability.

Heretofore, in order to provide such high temperature stability, it has been carried out to blend a stabilizer such as 2,6-di-t-buthyl-p-cresol, etc. into a base oil. However, the above stabilizer precipitates at the low temperature portion in the refrigerator system such as a swelling valve, a capillary tube, etc. whereby it causes problems of clogging circuit of the refrigerator system or inhibiting coolant flow. Thus, a phenomenon preventing normal operation of the refrigerator has been caused.

Accordingly, the present inventor has intensively studied to solve the problems of the above conventional refrigerator oil, etc., and to develop a lubricating oil with excellent high temperature stability and at the same time have improved low temperature characteristics.

As a result, it has been found that the above object can be accomplished by blending an alkyl group-substituted phenol compound having a melting point of 20° C. or lower and a base oil of a lubricating oil which is highly purified and has a specific characteristic with a specific ratio. The present invention has completed based on such a finding.

An object of the present invention is to provide a lubricating oil composition with excellent high temperature stability and low temperature characteristics.

Also, another object of the present invention is to provide a lubricating oil composition used as a stable refrigerator oil, etc., under a Flon coolant atmosphere.

DISCLOSURE OF INVENTION

That is, the present invention is to provide a lubricating oil composition which comprises, as main components, (A) 100 parts by weight of a base oil having a kinematic viscosity at 40° C. of 5 to 500 cSt, a pour point of −30° C. or lower and a viscosity index of 70 or more, and (B) 0.01 to 5 parts by weight of an alkyl group-substituted phenol compound having a melting point of 20° C. or lower.

The lubricating oil composition of the present invention comprises the above components (A) and (B) as the main components, and the base oil of Component (A) has a kinematic viscosity at 40° C. of 5 to 500 cSt, preferably 10 to 300 cSt. In the material having the kinematic viscosity at 40° C. of less than 5 cSt, wear-resistance and extreme pressure properties are lowered. On the other hand, if it exceeds 500 cSt, undesirably increasing power loss results due to high viscosity. Also, the pour point of the base oil should be −30° C. or lower, preferably −35° C. or lower. There are no specific limits regarding the cloud point, but preferably—20° C. or lower, most preferably −30° C. or lower. If the pour point exceeds −30° C., precipitates are generated at low temperature, and as the result, there is a fear that it will clog a swelling valve, etc. of the refrigerator system when used as a refrigerator oil, etc. This phenomenon is likely to result when the cloud point exceeds −20° C., and therefore it is most preferred that the pour point is −30° C. or lower and the cloud point is −20° C. or lower.

Further, the base oil shall have a viscosity index of 70 or more, particularly preferably 75 or more. If the viscosity index is less than 70, the sealing property at high temperature is lowered and wear-resistance is also lowered so that it is undesirable. In the base oil as the above component (A), there are no particular limitations regarding a content of aromatic component (%$C_A$; ring analysis value based on the n-d-M method), but 5% or less is preferred and 3% or less is particularly suitable.

As such a base oil, either mineral oils or synthetic oils can be used so long as they have the above properties, but mineral oils are generally used, and if desired, it is effective to blend the synthetic oils into mineral oils within the range of 50% by weight or less.

As the above mineral oils, those obtained by various methods can be used, and there can be mentioned, for example, as preferred ones, deep dewaxed oils which is obtained by purifying distilled oils obtained by atmospheric distillation of paraffin base type crude oils or intermediate base type crude oils, or distilled oils obtained by vacuum distilling the residual oil from the atmospheric distillation, and by further subjecting them to deep dewaxing treatment. As the method of purifying the distilled oils at this time is not particularly limited and various methods can be considered. Usually, the distillate oil is purified by applying such treatments as (a) hydrogenation, (b) dewaxing (solvent dewaxing or hydrogenation dewaxing), (c) solvent extraction, (d) alkali distillation or sulfuric acid treatment, and (e) clay filtration, alone or in combination with one another. It is also effective to apply the same treatment repeatedly at multi-stages. For example, (1) a method in which the distillate oil is hydrogenated, or after hydrogenation, it is further subjected to alkali distillation or sulfuric acid treatment, (2) a method in which the distillate oil is subjected to hydrogenation treatment and then to dewaxing treatment, (3) a method in which the distillate oil is subjected to solvent extraction treatment and then to hydrogenation treatment, (4) a method in which the distillate oil is subjected to two- or three-stage hydrogenation treatment, or after the two- or three-stage hydrogenation treatment, it is further subjected to alkali distillation or sulfuric acid treatment, and the like.

As a mineral oil to be used as Component (A) of the present invention, it is suitable to use the thus obtained purified oils which are again subjected to dewaxing treatment, if necessary, to make a deep dewaxed oil. The dewaxing treatment herein carried out is so-called deep dewaxing treatment and can be carried out by the solvent dewaxing treatment under severe conditions or the catalytic hydrogenation dewaxing treatment using a Zeolite catalyst.

Also, as a synthetic oil to be used in combination with the above mineral oils, there can be mentioned various ones such as alkylbenzene, polyglycol ether, polyol ester, poly olefin, etc.

Next, in the lubricating oil composition of the present invention, as Component (B), an alkyl group-substituted phenol compound is used and acts as a stabilizer. This alkyl group-substituted phenol compound should have a melting point (a coagulating point) of 20° C. or lower, preferably a melting point of 10° C. or lower, and more preferably 0° C. or lower. The number of the alkyl groups for substituting to the phenol compound is not particularly limited, and any of the mono-, di-, tri-substituted ones, etc. can be employed. Also, the kinds of the alkyl groups for substitution are preferably those having a carbon number of 6 to 21, and an oligomer of propylene (for example, an a alkyl group having 9 or 12 carbon number) is particularly optimum. In the alkyl group herein mentioned, there are included not only those represented by the formula $C_nH_{2n+1}$ (wherein n is an integer of 6 to 21), but also those having sulfur atoms or oxygen atoms in the alkyl chain.

In the present invention, an alkyl group-substituted phenol compound having a melting point of more than 20° C. is not suitable since it is likely to precipitate at a low temperature.

Specific examples of the alkyl group-substituted phenol compounds to be used in the present invention include p-nonylphenol; 2,6-di-nonylphenol; 2,6-di-nonyl-4-methylphenol; 2,2'-methylenebis(4-methyl-6-nonylphenol); 2,6-bis-(2-hydroxy-3-nonyl-5-methylbenzyl)p-cresol; p-dodecylphenol; m-pentadecylphenol; octadecylphenol; 2,6-di-t-butyl-4-(lauryl-thiomethyl)-phenol; 2,6-di-t-butyl-4-(nonylthiomethyl)phenol; etc.

In the lubricating oil composition of the present invention, based on 100 parts by weight of the base oil of the above Component (A), the alkyl group-substituted phenol compound as Component (B) is blended with a ratio of 0.01 to 5 parts by weight, preferable 0.1 to 2 parts by weight. If the blended amount of Component (B) is too small, insufficient effects result. On the other hand, if it is too excessive, improvement of the effects could not be expected, but rather it causes a lack of dissolving power whereby various undesirable problems, such as precipitation of the stabilizer, are likely to result.

The lubricating oil composition of the present invention comprises the above Component (A) and Component (B) as the main components, but if necessary, other additives such as chlorine scavengers, extreme pressure agents, oiliness agents, copper deactivators, defoaming agents, etc. can optionally be blended.

Here, as the chlorine scavengers, an epoxy series compound can be mentioned as a representative one, and examples of the epoxy series compound include monoalkylglycidyl ethers (monomethylglycidyl ether, monobutylglycidyl ether, mono 2-ethylhexylglycidyl ether, monodecylglycidyl ether, monostearylglycidyl ether, monophenylglycidyl ether, mono sec-butylphenylglycidyl ether, etc.), epoxidized aliphatic acid monoesters (epoxidized methyl oleate, epoxidized butyl oleate, epoxidized octyl oleate, epoxidized methyl stearate, epoxidized butyl stearete, epoxidized octyl stearate, etc.), epoxidized oils and fats (epoxidized soybean oil, epoxidized cotton seed oil, epoxidized linseed oil, epoxidized safflower oil, etc.) and epoxyhexahydrophthalates (epoxidized octyl hexahydrophthalate; 3,4-epoxycyclohexylmethyl; 3',4'-epoxycyclohexanecarboxylate, etc.).

Also, as the extreme pressure agents, there can be mentioned phosphorus type extreme pressure agents and sulfur type extreme pressure agents, and among these, the phosphorus type extreme pressure agents can be classified into phosphate type (triphenyl phosphate, tricresyl phosphate, tri(isopropylphenyl) phosphate, tributylphosphate, trioctylphosphate, triphenyl thiophosphate, tricresyl thiophosphate, etc.) and phosphite type (triphenyl phosphite, tricresyl phosphite, tri(nonylphenyl)phosphite, trilauryl phosphite, tristearyl phosphite, trilauryl thiophosphite, etc.). Also, specific examples of the sulfur type extreme pressure agents include di-laurylthiodipropionate, ditridecylthiodipropionate, distearylthiodipropionate, thiophen, benzothiophen, dodecylsulfide, stearylmercaptane, etc.

Further, as the oiliness agents, there can be included di(2-ethylhexyl)sebacate, di(2-ethylhexyl)azerate, etc. and the copper deactivators include benzotriazole, methylbenzotriazole, dimethylbenzotriazole, mercaptobenzothiazole, etc. and the defoaming agents include dimethylsilicone, phenylmethylsilicone, etc.

Next, the present invention will be described in more detail by referring to Examples and Comparative examples.

EXAMPLES 1 TO 3 AND COMPARATIVE EXAMPLES 1 TO 11

Lubricating oil compositions were prepared by blending the mineral oils (Component (A)) having properties shown in Table 1 and prescribed stabilizers (Component (B)).

Next, regarding the resulting lubricating oil compositions, tests of low temperature characteristics and high temperature stability were carried out. The results are

TABLE 1

| | Mineral oil I | Mineral oil II | Mineral oil III | Mineral oil IV |
|---|---|---|---|---|
| Kinematic viscosity (40° C.) (cSt) | 31.8 | 31.9 | 31.8 | 31.9 |
| Viscosity index | 91 | 108 | 106 | 23 |
| Pour point (°C.) | −45 | −17.5 | −17.5 | −40 |
| Cloud point (°C.) | −45 | −15 | −15 | −35 |
| $\%C_A$ | 0.1 or less | 5 | 0.1 or less | 11.0 |

TABLE 2

| Items | | | No. | | | | | | | | | | | | | |
|---|---|---|---|---|---|---|---|---|---|---|---|---|---|---|---|---|
| | | | Example | | | Comparative example | | | | | | | | | | |
| | | | 1 | 2 | 3 | 1 | 2 | 3 | 4 | 5 | 6 | 7 | 8 | 9 | 10 | 11 |
| Composition of components (parts by weight) | Component (A) | Mineral oil I | 100 | 100 | 100 | 100 | 100 | 100 | 100 | — | — | — | — | — | — | — |
| | | Mineral oil II | — | — | — | — | — | — | — | 100 | — | — | — | — | — | — |
| | | Mineral oil III | — | — | — | — | — | — | — | — | 100 | — | — | — | — | — |
| | | Mineral oil IV | — | — | — | — | — | — | — | — | — | 100 | 100 | 100 | 100 | 100 |
| | Component (B) | Stabilizer*1 | 0.5 | — | — | — | — | — | — | — | — | — | — | — | — | — |
| | | Stabilizer*2 | — | 0.5 | — | — | — | — | — | — | — | — | 0.5 | — | — | — |
| | | Stabilizer*3 | — | — | 0.5 | — | — | — | — | — | — | — | — | 0.5 | — | — |
| | | Stabilizer*4 | — | — | — | — | 0.5 | — | — | — | — | — | — | — | — | — |

TABLE 2-continued

| | | | | | | | | | | | | | | | |
|---|---|---|---|---|---|---|---|---|---|---|---|---|---|---|---|
| | | Stabilizer*5 | — | — | — | — | — | 0.5 | — | — | — | — | — | — | 0.5 | — |
| | | Stabilizer*6 | — | — | — | — | — | — | 0.5 | — | — | — | — | — | — | 0.5 |

| | | | | No. | | | | | | |
|---|---|---|---|---|---|---|---|---|---|---|
| | | | | Example | | | Comparative example | | | |
| | | Items | | 1 | 2 | 3 | 1 | 2 | 3 | 4 |
| Test results | Low temperature characteristics | Pour point*7 (°C.) | | −47.5 | −47.5 | −47.5 | −47.5 | −47.5 | −47.5 | −47.5 |
| | | Shield*8 flock point (°C.) | Sample oil | −52 | −52 | −52 | −52 | −52 | −52 | −52 |
| | | | Stabilizer concentration 10 wt % | −52 | −52 | −52 | — | −47 | +65 | +41 |
| | | | Stabilizer concentration 100 wt % | −55> | −55> | −55> | — | −22 | +82 | +50 |
| | High temperature Stability | Thermal*9 stability | Presence of precipitates | None | None | None | None | None | None | None |
| | | | Increased total acid value*11 | 0.03 | 0.02 | 0.04 | 0.70 | 0.05 | 0.04 | 0.09 |
| | | Shield*10 tube test | Presence of precipitates | None | None | None | None | None | None | None |
| | | | Appearance (Color hue) | L0.5 | L0.5 | L0.5 | L2.0 | L0.5 | L0.5 | L1.0 |
| | | | HCl formed amount* | 0.4 | 0.5 | 0.7 | 3.3 | 0.8 | 0.9 | 1.2 |

| | | | | No. | | | | | | |
|---|---|---|---|---|---|---|---|---|---|---|
| | | | | Comparative example | | | | | | |
| | | Items | | 5 | 6 | 7 | 8 | 9 | 10 | 11 |
| Test results | Low temperature characteristics | Pour point*7 (°C.) | | −12.5 | −17.5 | −37.5 | −37.5 | −37.5 | −37.5 | −37.5 |
| | | Shield*8 flock point (°C.) | Sample oil | −15 | −18 | −24 | −24 | −24 | −23 | −23 |
| | | | Stabilizer concentration 10 wt % | — | — | — | — | — | — | — |
| | | | Stabilizer concentration 100 wt % | — | — | — | — | — | — | — |
| | High temperature Stability | Thermal*9 stability | Presence of precipitates | None | Present | Present | Present | Present | Present | Present |
| | | | Increased total acid value*11 | 0.91 | 0.78 | 8.0 | 6.5 | 6.0 | 7.0 | 7.1 |
| | | Shield*10 tube test | Presence of precipitates | None | Present | Present | Present | Present | Present | Present |
| | | | Appearance (Color hue) | L5.0 | L2.0 | L8.0 | L8.0 | L8.0 | L8.0 | L8.0 |
| | | | HCl formed amount* | 5.8 | 4.1 | 36 | 33 | 37 | 36 | 39 |

*1P-Nonylphenol, produced Tokyo Chemical Industry Co., Ltd.
*2,2'-Methylenebis(4-methyl-6-nonylphenol), produced by Ouchi Shinko Chemical Industry Co., Ltd., Noclyzer NS-90.
*3A mixture of 2,2'-Methylenebis(4-methyl-6-nonylphenol) and 2,6-bis(2-hydroxy-3-nonyl-5-methylbenzyl)p-cresol, produced by Sumitomo Chemical Industry Co., Ltd., Sumilyzer NW (N).
*42,6-di-t-butyl-p-cresol (melting po.nt of 20° C. or more), produced by Sumitomo Chemical Industry Co., Ltd., Sumilyzer BHT.
*54,4'-methylenebis(2,6-di-t-butylphenol) (20° C. or more), Ethyl Co., Ltd. Antioxidant 702.
*6Styrenated phenol, (melting point of 20° C. or lower), produced by Sumitomo Chemical Industry Co., Ltd., Sumilyzer S.
*7Pour Point According to JIS K-2269.
*8Shield flock point
Into a pressure-resistant ampoule having an inner content of 10 ml and made of a glass was weighed 0.4 g of a sample oil, the pressure in the ampoule was reduced, and 3.6 g of a coolant 3,6-dichlorodifluoromethane (R-12) was charged while cooling with liquid nitrogen, and then it was sealed by a burner. This sealed ampoule was put into a low temperature thermostat, cooled stepwise and observation of the ampoule contents at each temperature was carried out. By this observation, the temperature at which flock appeared was made the flock point.
*9Thermal stability test According to JIS K-2540.
*10Shield tube test
4 ml of a sample oil was injected with an injector into a pressure-resistant ampoule made of a glass having an inner content of 10 ml and a steel, copper and aluminum wires inserted therein, and degassing treatment was carried out. While cooling it with liquid nitrogen, 2 g of dichlorodifluoromethane as a coolant was introduced therein and the ampoule was sealed with a burner. This sealed ampoule was allowed to stand in an oil bath at 175° C. for 480 hours. After completion of the test, the ampoule was cooled with liquid nitrogen and opened, and the contents from the opened edge were absorbed with about 100 ml of distilled water. Then, the amount of hydrochloric acid formed was calculated by titrating with 0.1 N potassium hydroxide solution and the change in appearance of the oil was observed.
*11Unit is mg.KOH/g.
*12Unit is mg.KOH/4 ml.

As can be seen from the above Table 2, the lubricating oil composition of Examples 1 to 3 show low pour points and good results in the shield tube test. In addition, the shield flock points are low not only in the sample oil itself but also in the case where the concentration of the stabilizer becomes high (that is, stabilizer concentration of 10% and 100%) so that no precipitate is formed even at low temperatures.

Also, in Comparative examples 2 and 3, since the stabilizers having a melting point of 20° C. or higher are used, if the stabilizer concentration becomes high, the shield flock point also becomes high so that precipitates are likely to form. Further, in Comparative example 4, while it uses a stabilizer having a melting point of not more than 20° C., the kind is other than the alkyl group-substituted phenol compound, whereby the same results can be obtained as in those of Comparative examples 2 and 3. The other Comparative examples (Comparative examples 5 to 11) are each insufficient in both of low temperature characteristics and high temperature stability.

INDUSTRIAL APPLICABILITY

As explained above, the lubricating oil composition of the present invention has excellent high temperature stability and low temperature characteristics, and no precipitate is formed even at a low temperature and it is stable even under a Flon atmosphere as a coolant.

Accordingly, the lubricating oil composition of the present invention can be widely and effectively utilized as a refrigerator oil, a heat pump oil, a hydraulic oil, a heat transfer medium oil, etc.

I claim:

1. A lubricating oil composition comprising, as essential components, (A) 100 parts by weight of a base oil having a kinematic viscosity at 40° C. of 5 to 500 cSt, a pour point of −30° C. or lower, a cloud point of −20° C. or lower and a viscosity index of 70 or more, and (B) 0.01 to 5 parts by weight of at least one alkyl group-substituted phenol compound having a melting point of 20° C. or lower selected from the group consisting of 2,2′-methylenebis(4-methyl-6-nonylphenol); 2,6-bis(2-hydroxy-3-nonyl-5-methylbenzyl)p-cresol; and p-nonylphenol in which the nonyl group is formed by removing a hydrogen from propylene trimer.

2. A lubricating oil composition according to claim 1, wherein (A) the base oil is a deep dewaxed oil.

3. The lubricating oil composition according to claim 1, wherein the composition comprises, as essential components, (A) 100 parts by weight of the base oil and (B) 0.1 to 2 parts by weight of the alkyl group-substituted phenol compound.

* * * * *